US008168905B2

(12) United States Patent
Yang

(10) Patent No.: US 8,168,905 B2
(45) Date of Patent: May 1, 2012

(54) LIGHTING KEYBOARD

(75) Inventor: Liang-Yuan Yang, Keelung (TW)

(73) Assignee: Changshu Sunrex Technology Co., Ltd., Jiangsu Province (CN)

( * ) Notice: Subject to any disclaimer, the term of this patent is extended or adjusted under 35 U.S.C. 154(b) by 299 days.

(21) Appl. No.: 12/581,567

(22) Filed: Oct. 19, 2009

(65) Prior Publication Data

US 2011/0089005 A1 Apr. 21, 2011

(51) Int. Cl.
*H01H 9/00* (2006.01)

(52) U.S. Cl. ..... 200/314

(58) Field of Classification Search ..... 200/314
See application file for complete search history.

(56) References Cited

U.S. PATENT DOCUMENTS

| | | | | |
|---|---|---|---|---|
| 7,671,289 | B2 * | 3/2010 | Matsukawa et al. | 200/313 |
| 2009/0173606 | A1 * | 7/2009 | Liao et al. | 200/310 |
| 2010/0147660 | A1 * | 6/2010 | Lin | 200/314 |

* cited by examiner

*Primary Examiner* — Renee Luebke
*Assistant Examiner* — Lheiren Mae Caroc
(74) *Attorney, Agent, or Firm* — Abelman, Frayne & Schwab

(57) ABSTRACT

A lighting keyboard includes a keyboard unit, and a combined circuit and lighting unit. The keyboard unit has a keyboard base, press keys mounted on the keyboard base, and an elastic layer disposed between the press keys and the keyboard base, and having elastic members disposed beneath the press keys. The combined circuit and lighting unit includes a membrane circuit substrate underlying the keyboard base, a first light-blocking layer disposed on top of the membrane circuit substrate, a first reflecting layer underlying the membrane circuit substrate, a backlighting module, and a second light-blocking layer. The backlighting module underlies the first reflecting layer, and cooperates with the first light-blocking layer, the membrane circuit substrate, and the first reflecting layer to define a light passage. The second light-blocking layer underlies the backlighting module. Light generated from the backlighting module is transmitted toward the press keys through the light passage.

4 Claims, 5 Drawing Sheets

LIGHTING KEYBOARD

BACKGROUND OF THE INVENTION

1. Field of the Invention

This invention relates to a keyboard, more particularly to a lighting keyboard.

2. Description of the Related Art

Referring to FIGS. 1 and 2, a conventional lighting keyboard includes a keyboard unit 1, a membrane circuit substrate 31, and a backlighting unit 33 that underlies the keyboard unit 1. The keyboard unit 1 includes an aluminum keyboard base 32 that underlies the membrane circuit substrate 31 and that is disposed on top of the backlighting unit 33, an elastic layer 30 that is disposed on top of the membrane circuit substrate 31, a plurality of press keys 10 that are mounted on the keyboard base 32, and a plurality of X-shaped link-levers 34 that are mounted on the keyboard base 32, and that extend upwardly through the keyboard base 32 and the elastic layer 30 for supporting the press keys 10. The press keys 10 are movable upwardly and downwardly by virtue of the X-shaped link-levers 34.

Light emitted from the backlighting unit 33 can be transmitted through gaps in the keyboard base 32 and to bottom sides of the press keys 10, thereby illuminating the press keys 10. Accordingly, this conventional lighting keyboard can be easily used in a place with insufficient light. However, since the rigid keyboard base 32 separates the membrane circuit substrate 31 and the backlighting unit 33, a thickness of the lighting keyboard is unable to be further reduced.

SUMMARY OF THE INVENTION

The object of the present invention is to provide a lighting keyboard that can overcome the aforesaid drawback of the prior art.

According to this invention, a lighting keyboard includes a keyboard unit, and a combined circuit and lighting unit. The keyboard unit has a keyboard base, a plurality of press keys that are mounted on the keyboard base, and an elastic layer that is disposed between the press keys and the keyboard base, and that has a plurality of elastic members respectively disposed beneath the press keys. The combined circuit and lighting unit includes a membrane circuit substrate that underlies the keyboard base, a first light-blocking layer that is disposed on top of the membrane circuit substrate, a first reflecting layer that underlies the membrane circuit substrate, a backlighting module, and a second light-blocking layer. The backlighting module underlies the first reflecting layer, and cooperates with the first light-blocking layer, the membrane circuit substrate, and the first reflecting layer to define a light passage. The second light-blocking layer underlies the backlighting module. Light generated from the backlighting module is transmitted toward the press keys through the light passage.

BRIEF DESCRIPTION OF THE DRAWINGS

Other features and advantages of the present invention will become apparent in the following detailed description of the preferred embodiment of this invention, with reference to the accompanying drawings, in which.

DETAILED DESCRIPTION OF THE PREFERRED EMBODIMENTS

Figure 1:
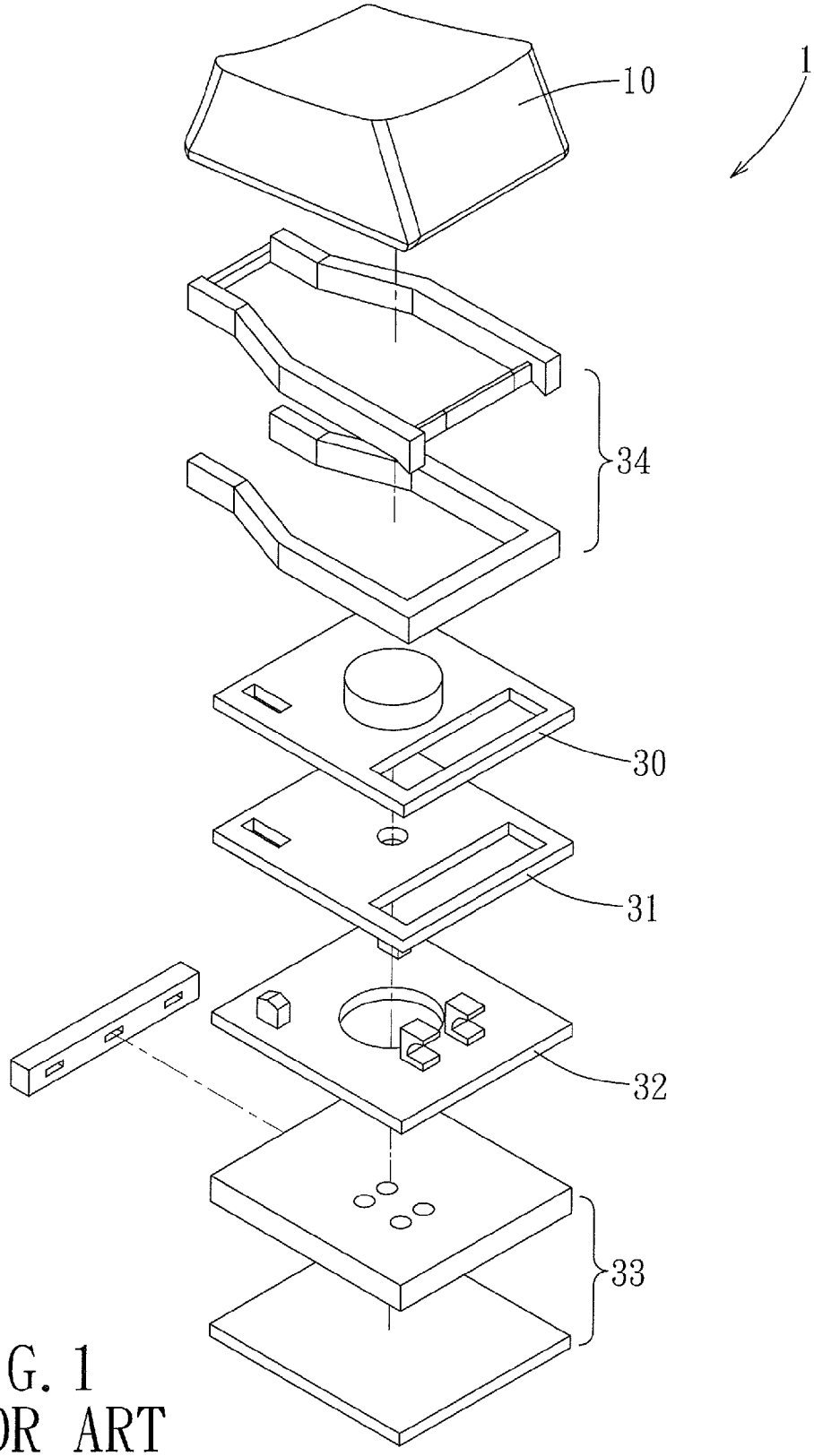
FIG. 1 PRIOR ART
FIG. 1 is a fragmentary exploded perspective view of a conventional lighting keyboard.

Referring to FIGS. 3, 4, 5, and 6, the preferred embodiment of a lighting keyboard according to the present invention includes a keyboard unit 1', and a combined circuit and lighting unit 2 that underlies the keyboard unit 1'.

The keyboard unit 1' has a keyboard base 32' that is made of aluminum, a plurality of press keys 10' that are mounted on the keyboard base 32' and that are made of a light-transmissive material, an elastic layer 30' that is disposed between the press keys 10' and the keyboard base 32', and that has a plurality of elastic members 301 respectively disposed beneath the press keys 10', and a plurality of X-shaped link-levers 34' that are mounted on the keyboard base 32' and that extend upwardly for supporting respectively the press keys 10'. The press keys 10 are movable upwardly and downwardly by dint of the X-shaped link-levers 34'.

The combined circuit and lighting unit 2 includes a membrane circuit substrate 22 that underlies the keyboard base 32 and that is made from a light-transmissive material, a first light-blocking layer 220 that is disposed on top of the membrane circuit substrate 22 and that is made of an opaque dark coating, a first reflecting layer 221 that underlies the membrane circuit substrate 22 and that is made of a light reflective coating having a white high gloss, an insulative spacer layer 210 that is disposed between the first reflecting layer 221 and the backlighting module 21, a second reflecting layer 211 that is disposed between the insulative spacer layer 210 and the backlighting module 21, and that is made of the light reflective coating for the first reflecting layer 221, a backlighting module 21, and a second light-blocking layer 215 that underlies the backlighting module 21.

The backlighting module 21 includes a light guide layer 212 that is disposed beneath the second reflecting layer 211, a light-scattering layer 213 that is formed on a bottom surface of the light guide layer 212, and a reflector layer 214 that underlies the light-scattering layer 213. The light guide layer 212 and the reflector layer 214 are formed with holes 2161, 2162, respectively. The second light-blocking layer 215 underlies the reflector layer 214.

In this embodiment, the backlighting module 21 further includes a light emitter substrate 218 that is disposed beneath the second light-blocking layer 215 and that is a flexible printed circuit board, and a light emitting element 217 that is disposed on the light emitter substrate 218 and that is a light emitting diode. The light emitting element 217 is electrically connected to the light emitter substrate 218 and extends into the holes 2161,6162. The light-scattering layer 213 includes a plurality of transparent ink dots 2130 that are formed on the bottom surface of the light guide layer 212. The ink dots 2130 may be randomly or evenly spaced apart from each other on the bottom surface of the light guide layer 212.

The backlighting module 21 cooperates with the first light-blocking layer 220, the membrane circuit substrate 22, the first reflecting layer 221, the insulative spacer layer 210, and the second reflecting layer 211 to define a light passage. Light generated from the backlighting module 21 is transmitted toward the press keys 10' through the light passage. Specifically, each of the first light-blocking layer 220, the first reflecting layer 221, the insulative spacer layer 210, and the second reflecting layer 211 has a plurality of holes that correspond to the press keys 10' and that constitute the light passage, thereby allowing light to pass therethrough.

When electricity is supplied to the light emitting element 217, light 2170 is generated and is uniformly diffused and transmitted to spaces in the lighting keyboard by virtue of the light passage. Consequently, the light 2170 can be transmitted to bottom sides of the press keys 10' and is able to illuminate the press keys 10'.

Figure 2:
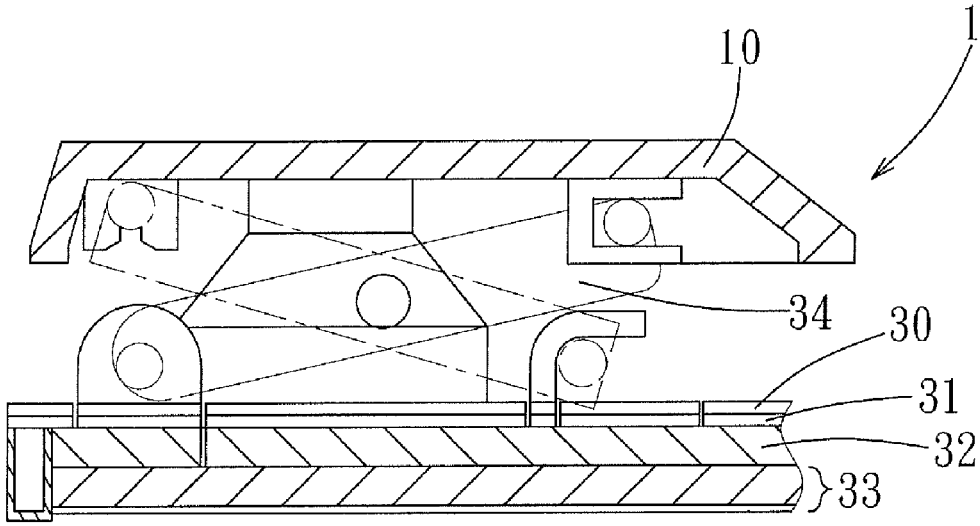
FIG. 2 PRIOR ART
FIG. 2 is a fragmentary schematic partly sectional view of the conventional lighting keyboard.
Figure 3:
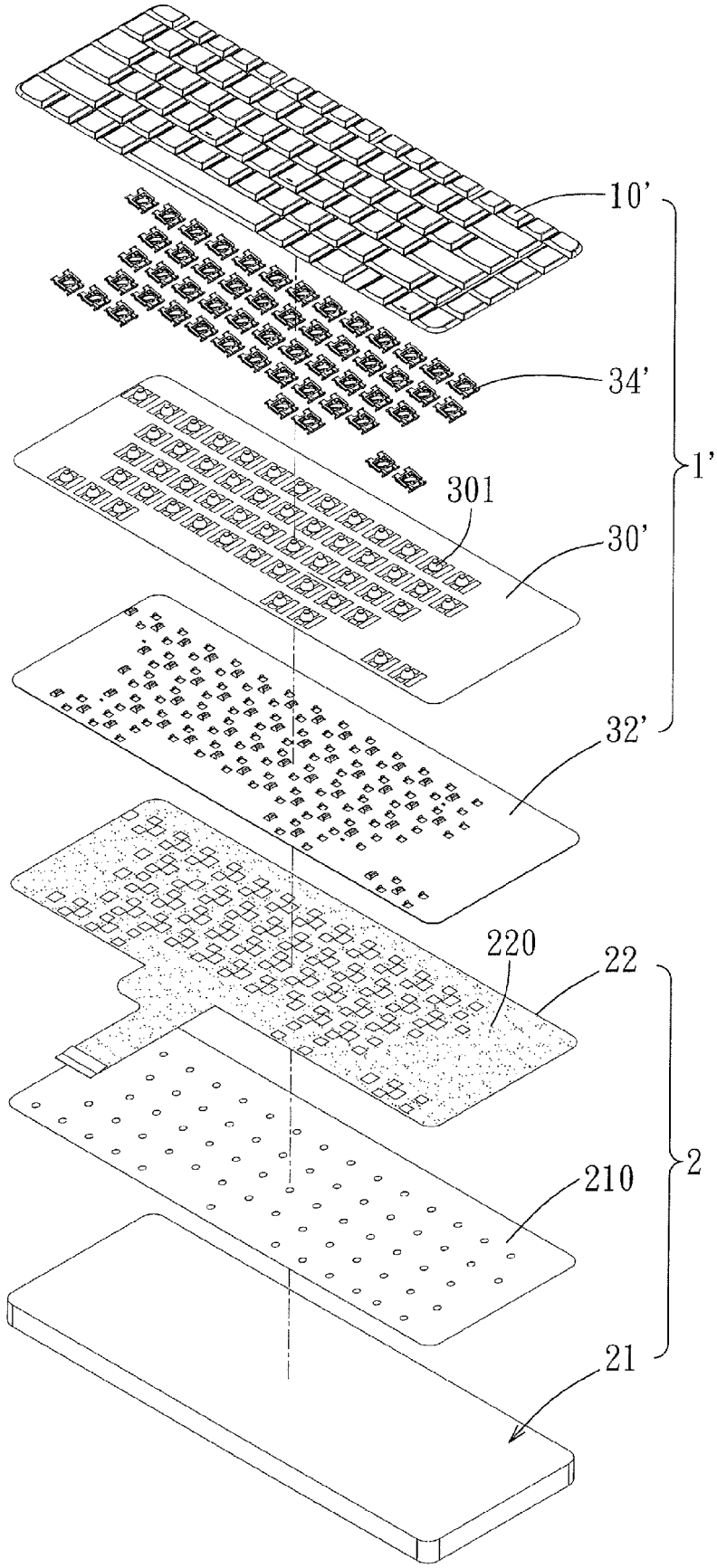
FIG. 3 is an exploded schematic perspective view of the preferred embodiment of a lighting keyboard according to this invention.
Figure 4:
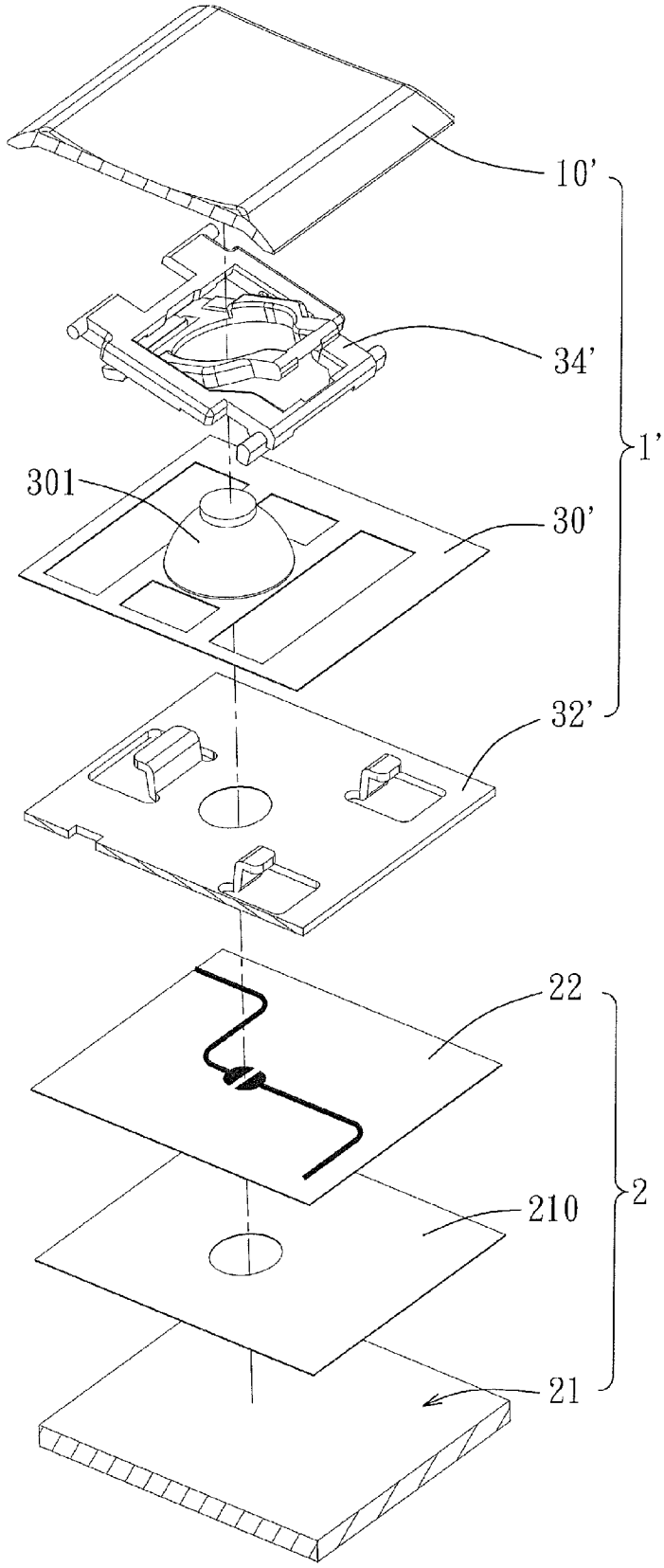
FIG. 4 is a fragmentary exploded schematic perspective view of the preferred embodiment.
Figure 5:
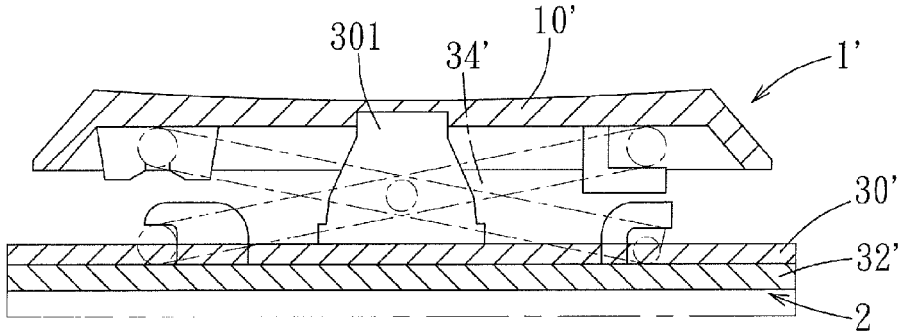
FIG. 5 is a fragmentary schematic partly sectional view of the preferred embodiment.
Figure 6:
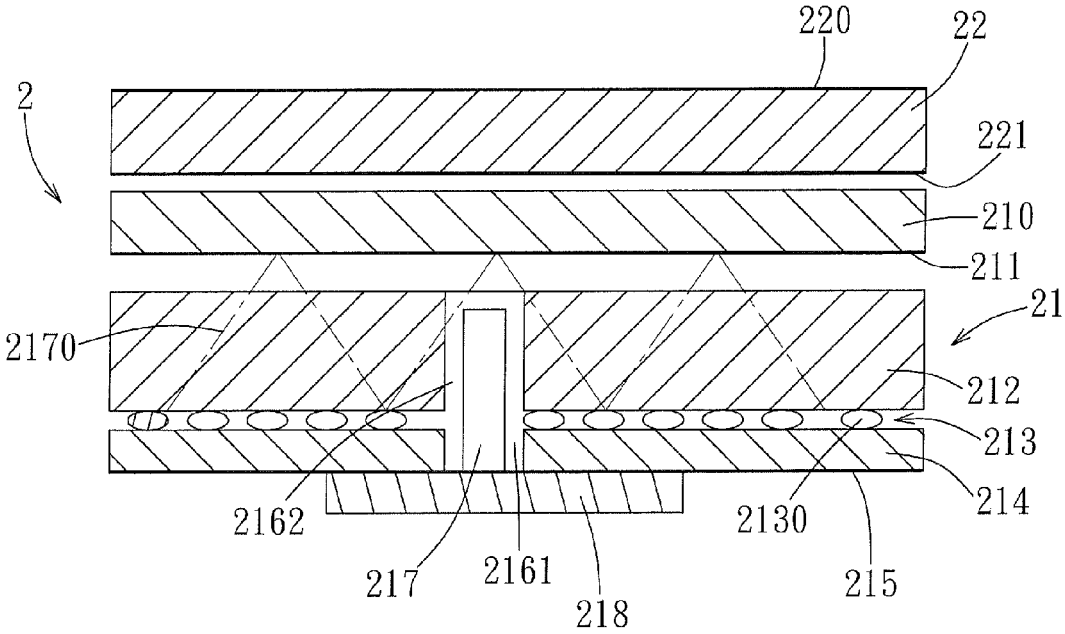
FIG. 6 is a fragmentary, partly exploded, schematic sectional view of a combined circuit and lighting unit of the preferred embodiment.

In sum, the membrane circuit substrate 31' and the backlighting module 21 are integrated into the combined circuit and lighting unit 2. Since the X-shaped link-levers 34' are only required to be extended through the elastic layer 30' for supporting the press keys 10', each of the X-shaped link-levers 34' can be designed to have a height less than that of each of the conventional X-shaped link-levers 34 (see FIGS. 1 and 2). Experiments show that a thickness of the keyboard unit 1' of this invention can be less than that of the conventional keyboard unit 1 (see FIGS. 1 and 2) by 0.25 mm, and that a thickness of the lighting keyboard of this invention can be less than that of the conventional lighting keyboard by 0.15 mm. Furthermore, a production cost for the lighting keyboard of this invention can be lowered.

While the present invention has been described in connection with what is considered the most practical and preferred embodiment, it is understood that this invention is not limited to the disclosed embodiment but is intended to cover various arrangements included within the spirit and scope of the broadest interpretation and equivalent arrangements.

What is claimed is:

1. A lighting keyboard comprising:

a keyboard unit having a keyboard base, a plurality of press keys that are mounted on said keyboard base, and an elastic layer that is disposed between said press keys and said keyboard base, and that has a plurality of elastic members respectively disposed beneath said press keys; and a combined circuit and lighting unit including:

a membrane circuit substrate that underlies said keyboard base;

a first light-blocking layer that is disposed on top of said membrane circuit substrate;

a first reflecting layer that underlies said membrane circuit substrate;

a backlighting module that underlies said first light-reflecting layer a second light-blocking layer that underlies said backlighting module;

an insulative spacer layer that is disposed between said first reflecting layer and said backlighting module; and a second reflecting layer that is disposed between said insulative spacer layer and said backlighting module, and that cooperates with said first light-blocking layer, said membrane circuit substrate, said first reflecting layer, said insulative spacer layer, and said backlighting module to define a light passage, wherein light generated from said backlighting module is transmitted toward said press keys through the light passage.

2. The lighting keyboard of claim 1, wherein said backlighting module includes a light guide layer that is disposed beneath said second reflecting layer, a light-scattering layer that is formed on a bottom surface of said light guide layer, and a reflector layer that underlies said light-scattering layer.

3. The lighting keyboard of claim 2, wherein said backlighting module further includes a light emitter substrate that is disposed beneath said second light-blocking layer, and a light emitting element that is disposed on said light emitter substrate, said light guide layer and said reflector layer being formed with holes, respectively, said light emitting element extending into said holes of said reflector layer and said light guide layer.

4. The lighting keyboard of claim 2, wherein said light-scattering layer includes a plurality of transparent ink dots formed on said bottom surface of said light guide layer.

* * * * *